US012546564B2

(12) United States Patent
Shearer

(10) Patent No.: US 12,546,564 B2
(45) Date of Patent: Feb. 10, 2026

(54) LOCKING BELT SLIDE

(71) Applicant: Tedder Industries, LLC, Post Falls, ID (US)

(72) Inventor: Jacob Shearer, Moses Lake, WA (US)

( * ) Notice: Subject to any disclaimer, the term of this patent is extended or adjusted under 35 U.S.C. 154(b) by 158 days.

(21) Appl. No.: 18/481,397

(22) Filed: Oct. 5, 2023

(65) Prior Publication Data

US 2024/0118054 A1 Apr. 11, 2024

Related U.S. Application Data

(60) Provisional application No. 63/413,649, filed on Oct. 6, 2022.

(51) Int. Cl.
*F41C 33/04* (2006.01)

(52) U.S. Cl.
CPC ..... *F41C 33/041* (2013.01)

(58) Field of Classification Search
CPC ..... F41C 33/041
USPC ..... 224/191
See application file for complete search history.

(56) References Cited

U.S. PATENT DOCUMENTS 5,850,996 A * 12/1998 Liang ..... H04M 1/04 248/221.11
5,927,580 A * 7/1999 Ward-Llewellyn ..... A45F 5/02 24/666
6,098,858 A * 8/2000 Laugesen ..... H04M 1/04 24/578.11
6,233,788 B1 * 5/2001 Choy ..... A45F 5/02 24/669
6,714,767 B2 * 3/2004 Fan ..... A45F 5/021 455/575.8
6,786,372 B2 * 9/2004 Enkerlin ..... A45F 5/02 455/100
6,981,623 B2 * 1/2006 Litsuka ..... A45F 5/02 24/663
7,261,264 B2 * 8/2007 Moran ..... A47G 7/044 248/221.11
7,409,237 B2 * 8/2008 Tages ..... H04M 1/04 455/575.1
D613,498 S * 4/2010 Tsai ..... D3/218
8,613,564 B2 * 12/2013 Busch ..... F16B 21/09 403/328
8,919,623 B1 * 12/2014 Bergeron ..... A45F 5/02 224/159
9,222,751 B2 * 12/2015 Glock ..... F41C 33/045
10,165,851 B1 * 1/2019 Downs ..... F21V 33/0008
10,222,172 B2 * 3/2019 Melville ..... F41C 33/041
11,047,644 B2 * 6/2021 Shearer ..... F41C 33/0263
11,678,736 B2 * 6/2023 Stegherr ..... A45F 5/021 224/269

* cited by examiner

*Primary Examiner* — Peter N Helvey

(57) ABSTRACT

A locking belt slide assembly is used to mount and to support an implement (such as a handgun, for example) or an implement holster (such as a handgun holster, for example), or the like (e.g., various pouches, holders, accessories, etc.), in a variety of configurations. The locking belt slide assembly includes at least two pivotally coupled hard mount components with features that form a locking receiver when pivoted into a parallel arrangement. A mounting adapter may be inserted into the receiver.

18 Claims, 9 Drawing Sheets

LOCKING BELT SLIDE

PRIORITY CLAIM AND CROSS-REFERENCE TO RELATED APPLICATION

This application claims the benefit under 35 U.S.C. § 119(e)(1) of U.S. Provisional Application No. 63/413,649, filed Oct. 6, 2022, which is hereby incorporated by reference in its entirety.

BACKGROUND

Implements, such as tools, weapons, and the like, may be encased in a holster for protection of the implement and/or the user, while providing access to the implement. For example, a holster may allow a user to conveniently carry the implement, safely retaining the implement until needed. When the implement is to be used, the user may withdraw the implement from the holster, and then return it to the holster when finished. In some cases, such as with a handgun for example, the holster may allow the user to conceal the implement, or to conceal the fact that the user is carrying the implement.

In the case of a handgun, the holster should reasonably protect the handgun and the user, and should be convenient to the user for ready use. However, the holster should also be versatile enough to be comfortably carried by the user, such as when it is worn on the person of the user for an extended length of time. The holster should also be rigid and stable enough to allow the handgun to be repeatedly drawn and re-holstered, usually with the same hand.

At times it can be desirable to carry an implement such as a handgun in various locations on the user, for instance on a leg or thigh of the user. However, when doing so, it is desirable that the holster or holster mount provides versatility in accessing the handgun, as well as a high level of protection to the user and also to the handgun. It can also be desirable for the holster or holster mount to be securely attached to the user, particularly in military or law enforcement applications, or the like, such as where the user may be engaged in running, jumping, climbing, or other physical activities.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Figure 1:
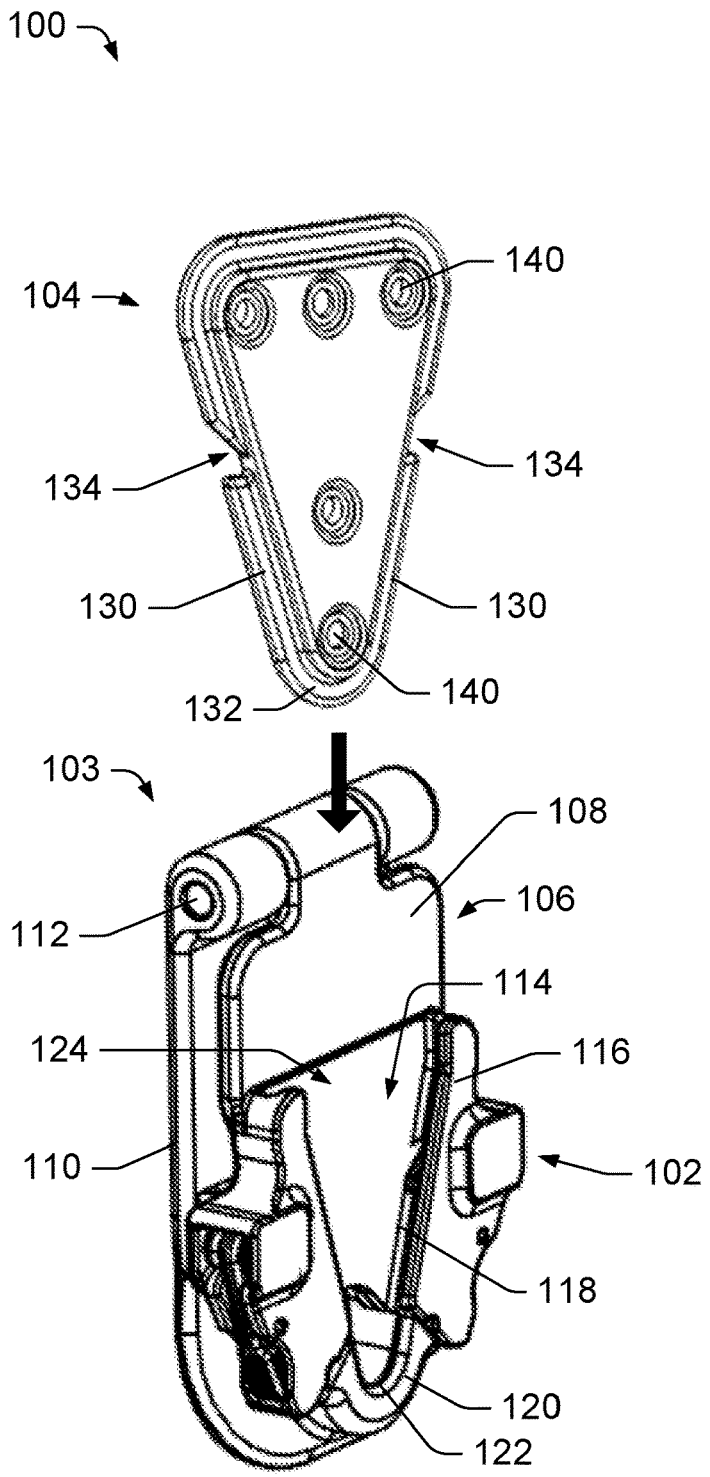
FIG. 1 shows a perspective view of an example adapter being inserted into an example locking belt slide assembly, according to an implementation.

Representative implementations of devices and techniques provide a locking belt slide assembly to mount and to support an implement (such as a handgun, for example) or an implement holster (such as a handgun holster, for example), or the like (e.g., various pouches, holders, accessories, etc.), in a variety of configurations. The locking belt slide assembly is arranged to be mounted in various locations for temporarily and safely mounting the implement, etc., while making the implement, etc. easily accessible to the user.

In some examples, the locking belt slide assembly may be mounted to user-wearable supports for carrying the implement. For example, a portion of the locking belt slide assembly (the holster plate or adapter, for instance) may be mounted to a handgun holster (as shown at FIG. 5, for example) and another portion of the locking belt slide assembly (the receiver, for instance) may be integral with (or mounted to) a wearable device, such as a belt slide, for instance, that may be worn by a user (e.g., on a user's belt, waistband, etc.). The locking belt slide assembly couples the holster to the belt slide for carrying the holster (in an outside-the-waistband (OWB) configuration, for example).

In another example, the belt slide for instance, may be mounted (using the hinged belt slide portions) to a convenient surface, such as within a vehicle, on a portion of a desk or other furniture, on a bedframe, or the like, either within view or concealed from view. The belt slide may be removed from one location and mounted to another location if desired. The adapter may be temporarily or permanently mounted to a handgun holster. The locking belt slide assembly can couple the holster to the convenient surface, within the vehicle, on a desk or other furniture, on a bedframe, or the like, for storing or mounting the holster. Techniques and devices are discussed with reference to example handgun holsters illustrated in the figures. However, this is not intended to be limiting, and is for ease of discussion and illustrative convenience. The techniques and devices discussed may be applied to a holster or to any of various cases, carriers, containers, implements, tools, objects, and the like, and remain within the scope of the disclosure. For the purposes of this disclosure, the generic term "carrier" is used to indicate any or all of the above.

Further, the shape and quantity of the locking belt slide components illustrated in the figures may vary to accommodate the various objects to be docked or mounted, as well as to accommodate various applications. In alternate embodiments, fewer, additional, or alternate components may be used and/or combined to form a locking belt slide assembly having an equivalent function and operation.

Implementations are explained in more detail below using a plurality of examples. Although various implementations and examples are discussed here and below, further implementations and examples may be possible by combining the features and elements of individual implementations and examples.

Example Locking Belt Slide Assembly

An example locking belt slide assembly 100, as shown in FIGS. 1-8, allows for a carrier (such as an implement or an implement holster, for example) to be mounted to an article of clothing (such as a belt), a user accessory, or other surface using a receiver 102 and an adapter 104. In various implementations, the receiver 102 is integral with or fixed to a belt slide 106, such as the 2-piece (or more) hinged belt slide 106 illustrated in FIG. 1. The combination of the receiver 102 and the belt slide 106 are referred to herein as the "receiver component 103." The receiver component 103 is shown in various configurations in the figures, with and without an adapter 104 disposed therein.

The adapter 104 is arranged to be temporarily or permanently fixed to a carrier (e.g., a holster, a case, an enclosure, a sheath, etc., see FIG. 6 for example) which may be configured to hold an implement (e.g., a tool, a weapon, an instrument, etc.), or the like, using one or more mounting holes 140 in the adapter 104 and permanent or temporary fasteners. The adapter 104 may also be temporarily or permanently fixed to an implement.

Figure 2A:
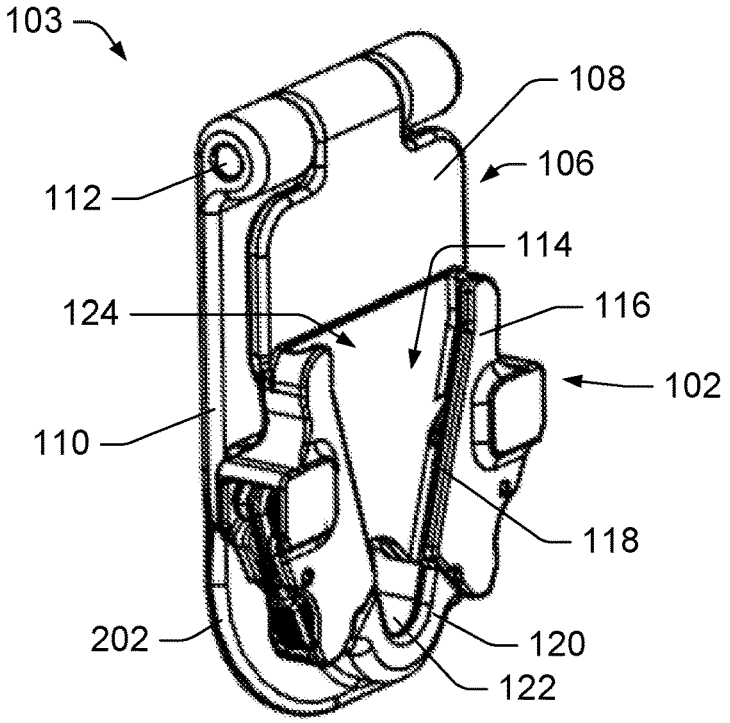
FIG. 2A shows a perspective view of an example locking belt slide assembly in a closed configuration, according to an implementation.
Figure 2B:
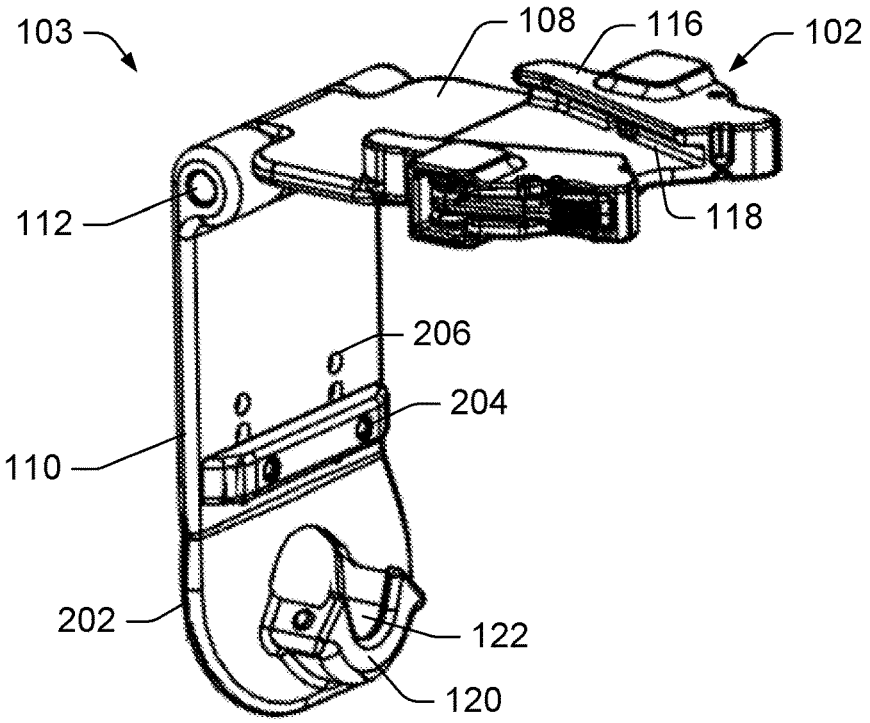
FIG. 2B shows a perspective view of an example locking belt slide assembly in an open configuration, according to an implementation.
Figure 2C:
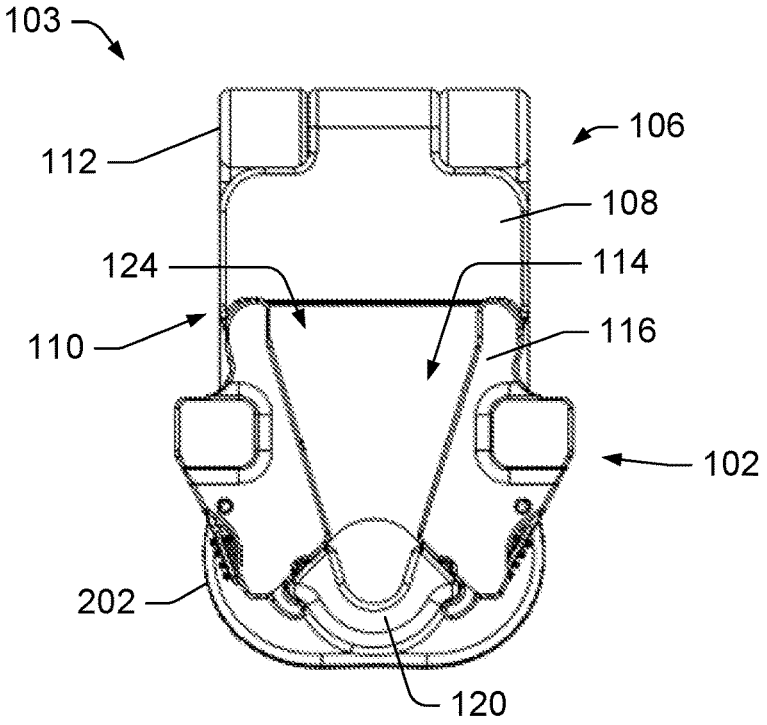
FIG. 2C shows a front view of an example locking belt slide assembly in a closed configuration, according to an implementation.
Figure 2D:
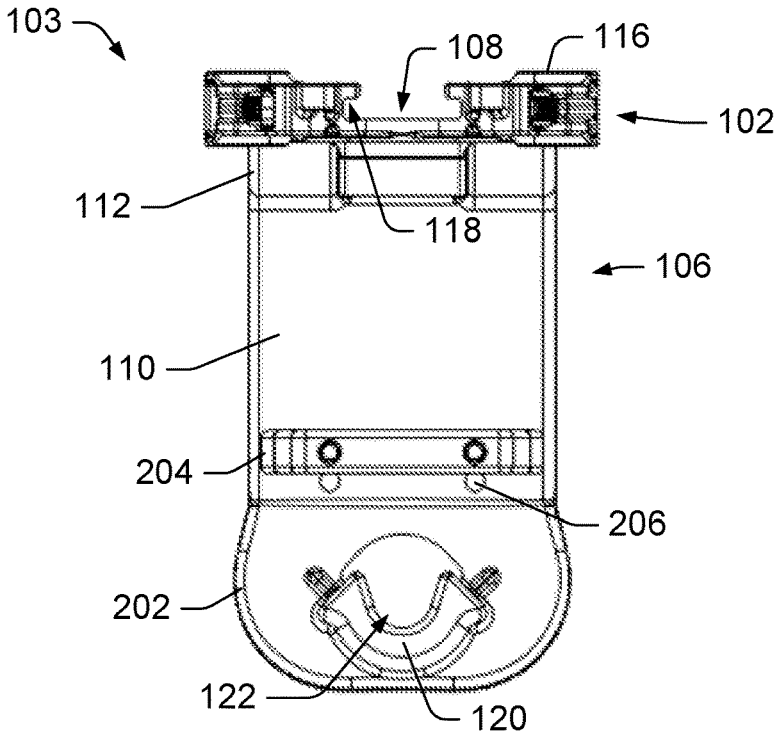
FIG. 2D shows a front view of an example locking belt slide assembly in an open configuration, according to an implementation.

Referring to FIGS. 1-2D, the belt slide 106 may comprise at least two substantially planar hard mount components (108 and 110) coupled together at one end of each planar component by a hinge 112 (or like coupler). The receiver 102 is integral (or fixed) to an upper planar hard mount component, the belt slide front 108. The belt slide back 110 is also substantially planar, and may include an inclined portion 202 at the lower part of the belt slide back 110. The inclined portion 202 brings the lower part of the belt slide back 110 nearer to the belt slide front 108 when the belt slide 106 is in the closed position. The top of the belt slide back 110 may be hinged to the top of the belt slide front 108.

The hinge 112 allows the belt slide front 108 and the belt slide back 110 to pivot away from each other, to move the belt slide 106 from the closed position to the open position. The hinge 112 also allows the belt slide front 108 and the belt slide back 110 to pivot toward each other, to move the belt slide 106 from the open position to the closed position. The pivoting capability of the belt slide 106 provides additional versatility than a fixed belt slide.

For example, when the belt slide 106 is in the open configuration, as shown at FIGS. 2B and 2D, the belt slide front 108 and the belt slide back 110 are separated. In this open configuration, the belt slide back 110 can be used like a paddle to slide over the top of a belt, for example, to secure the belt slide 106 to the user's belt. The belt slide front 108 can then be closed, by pivoting the belt slide front 108 at the hinge 112 toward the belt slide back 110, securing the user's belt within the belt slide 106. In some examples, a portion of the belt slide front 108 can engage another portion of the belt slide back 110 to secure the belt slide 106 together.

Pivoting the belt slide 106 components (108 and 110) to secure the belt slide 106 to the user's belt provides another convenient technique for the user to attach the belt slide 106 to the user's clothing or accessories, aside from threading the user's belt through a closed belt slide 106. This can save the user from having to remove the user's belt (or a portion of the user's belt) to attach the belt slide 106, which can sometimes also involve removing one or more accessories attached to the user's belt.

In some cases, the belt slide 106 may include one or more belt width adjustment components, such as the belt width adjustment bar 204 shown at FIG. 2B. The belt width adjustment bar 204 can be moved to different positions along the belt slide back 110 via belt width adjustment points 206 to decrease or increase the amount of space for different widths of belts within the belt slide 106. This can help the belt slide 106 to be more securely fitted to the user's belt, minimizing movement of the belt slide 106 on the user's belt. The belt width adjustment bar 204 can be secured to the belt slide back 110 at the belt width adjustment points 206 using various fasteners (e.g., bolts, screws, pins, etc.) and can be relocated to other adjustment points 206 as desired to fit different belts.

As shown at FIGS. 1-2D, the receiver 102 has a receiver pocket 114 arranged to receive the adapter 104. The receiver pocket 114 is formed by the presence of a frame 116 comprising a lip around a portion of the planar surface of the belt slide front 108. The frame 116 comprises a built-up or raised portion that extends away from the surface of the belt slide front 108, forming a ledge or bench around the portion of the surface. In some embodiments, the frame 116 includes a groove 118 along the inside edge of the frame 116. The interior area of the receiver 102 that is at least partially surrounded by the frame 116 comprises the pocket 114.

Referring particularly to FIGS. 2B and 2D, a belt slide lock 120 is disposed at a lower portion of the belt slide back 110, and protrudes from the belt slide back 110 as a raised feature with a curved configuration (or other shape to match the lower edge of the adapter 104). The belt slide lock 120 forms a ledge or bench (which includes a groove 122) protruding from the lower portion of the belt slide back 110.

Referring particularly to FIGS. 1, 2A, and 2C, the positioning of the belt slide lock 120 on the belt slide back 110 is such that when the two planar components (108 and 110) of the belt slide 106 are moved together at the hinge 112 and into a closed configuration (i.e., when the belt slide front 108 and the belt slide back 110 are substantially parallel), the belt slide lock 120 and the frame 116 of the receiver 102 meet to form a substantially continuous pocket frame for the adapter 104. The belt slide lock 120 and the frame 116 of the receiver 102 are aligned, and the frame 116 is substantially continuous with the ledge or bench that is the belt slide lock 120. The groove 122 is also aligned and substantially continuous with the groove 118 (so as to be able to receive the adapter 104). In some cases, the frame 116 of the receiver 102 and the belt slide lock 120 combine to form a U or V shape, or similar.

Referring back to FIGS. 2B and 2D, when the belt slide front 108 and the belt slide back 110 are pivoted away from each other (e.g., the open configuration), the belt slide lock 120 and the frame 116 of the receiver 102 are no longer aligned, and the frame 116 is not continuous with the ledge or bench of the belt slide lock 120. The groove 122 is also not aligned or continuous with the groove 118. The pocket 114 may not be arranged to fully receive the adapter 104 in the open configuration.

Figure 3A:
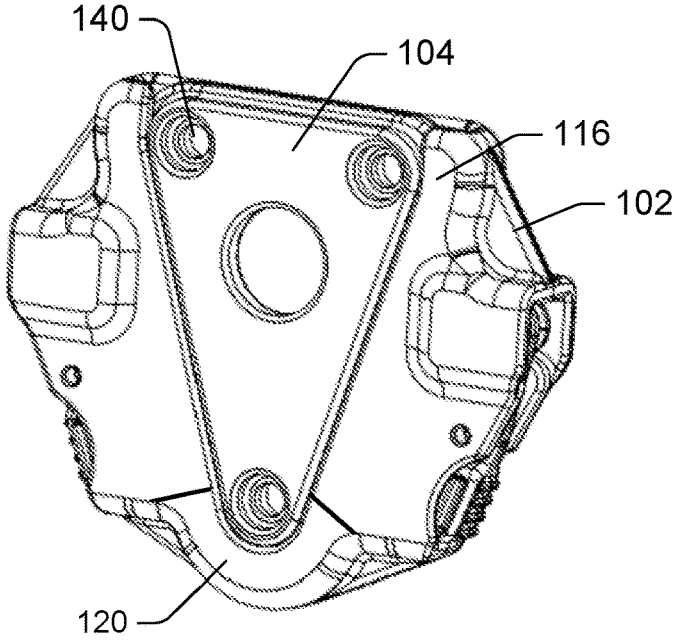
FIG. 3A shows a perspective view of an example adapter seated within an example receiver, according to an implementation.
Figure 3B:
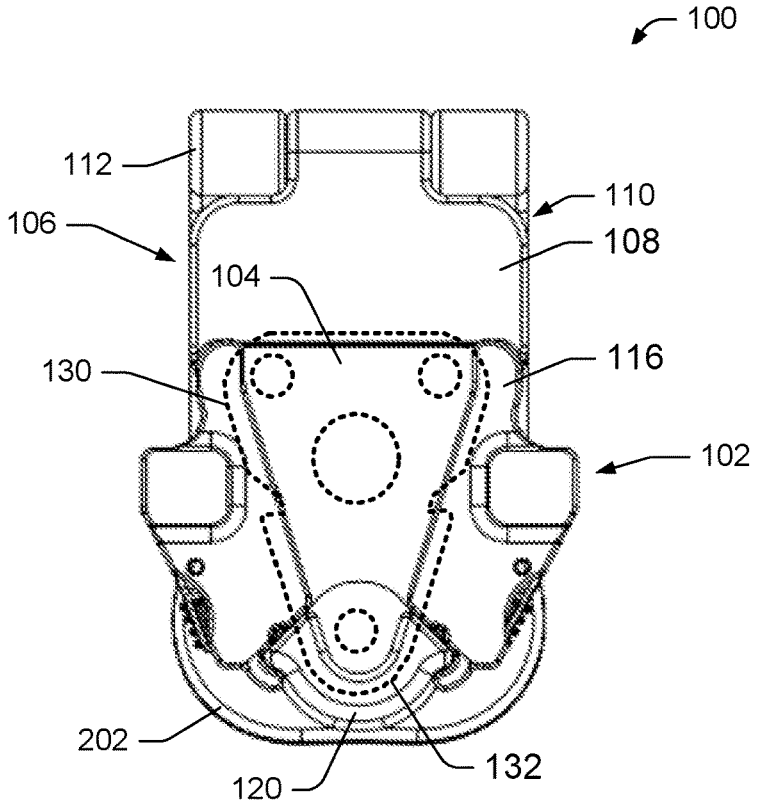
FIG. 3B shows a front view of an example adapter seated within an example locking belt slide assembly, according to an implementation.

As shown at FIGS. 1, 3A, 3B, 4A, and 4B, the constituents (103 and 104) of the locking belt slide assembly 100 are (removably) coupled together, and the belt slide front 108 and the belt slide back 110 are locked (together) in the closed configuration, by inserting the adapter 104 into the receiver pocket 114 of the receiver 102. As shown, the receiver pocket 114 and the adapter 104 are configured to have the same perimeter shape or a near-same shape, for a secure fit without undue movement of the adapter 104 within the receiver pocket 114. While a triangular shape for the adapter 104 and the receiver pocket 114 is illustrated in the figures (see FIG. 1), other shapes (e.g., elliptical, polygonal, irregular, etc.) are also within the scope of the disclosure. FIG. 3A shows an example adapter 104 seated within a receiver pocket 114 of an example receiver 102. FIG. 3B shows the adapter 104 in a dashed line, so as to illustrate the relationship between the rim 130, 132 of the adapter 104 relative to the frame 116 and the slide lock 120, both of which overlap the rims 130 and 132, respectively. The rims 130 and 132 sit within the grooves 118 and 122, respectively.

Referring to FIGS. 2A and 2C, the adapter 104 may be inserted into the receiver pocket 114 from the "top" or opening 124 of the receiver 102 when the belt slide 106 (i.e., the receiver component 103) is in the closed configuration. For example, the adapter 104 may be inserted fully into the receiver pocket 114 when the belt slide lock 120 is aligned with the frame 116 of the receiver 102.

As shown at FIGS. 1 and 2A, the frame 116 of the receiver 102 may include an opening 124 (where the frame 116 is not present) at the top portion of the receiver 102. This opening 124 in the frame 116 can be an opening to the pocket 114 for the adapter 104. The adapter 104 may be lined up with the receiver pocket 114, with the adapter 104 above the receiver 102 (as shown at FIG. 1, for example). The adapter 104 may be moved down through the opening 124 and into the receiver pocket 114 until fully engaging with the receiver 102 and the belt slide lock 120. In an alternate embodiment, the adapter 104 may be configured to enter the pocket 114 from the front of the receiver 102 or from another angle relative to the receiver 102.

In some embodiments, as shown at FIGS. 3A, 3B, 4A, and 4B, one or more edges 130 of the adapter 104 engage with one or more portions of the groove 118 of the receiver pocket 114 and one or more edges 132 engage with one or more portions of the groove 122 of the belt slide lock 120. For instance, the one or more edges 130 of the adapter 104 may slide behind the one or more portions of the frame 116 when the adapter 104 is moved down into the receiver pocket 114, guided by the groove 118. When the lower edges 132 of the adapter 104 seat into the interior groove 122 of the belt slide lock 120, the adapter 104 is fully within the receiver 102.

An example adapter 104 is shown at FIG. 1. The adapter 104 comprises a substantially planar component having a perimeter shape that is the same or nearly the same as the shape of the receiver pocket 114 and belt slide lock 120 when aligned. For example, at least a majority (more than 50%) of the perimeter shape of the adapter 104 is the same as the perimeter shape of the receiver pocket 114. In an embodiment, the adapter 104 includes a rim 130, 132 or ledge around at least a portion of the perimeter of the adapter 104 (where the rim 130 comprises one or more side edges and the rim 132 comprises one or more bottom edges of the adapter 104). The rim 130, 132 may comprise a thinner edge than the thickness of the adapter 104 inside the rim 130, 132. For instance, the rim 130, 132 may have a thickness that matches (e.g., is substantially the same as or slightly less than) the thickness of the groove 118 of the receiver pocket 114 and the groove 122 of the belt slide lock 120.

The rim 130, 132 may be configured to slide into the grooves 118, 122, which extend around at least a portion of the inside perimeter of the receiver pocket 114 and on the inside edge of the belt slide lock 120. For instance, the grooves 118, 122 can be a guide for the adapter 104 (and particularly the rim 130, 132) to slide into place within the receiver pocket 114 to engage with the receiver 102 and the belt slide lock 120. The grooves 118, 122, the receiver frame 116, and the belt slide lock 120 provide security, holding the adapter 104 in place within the receiver pocket 114.

Figure 4A:
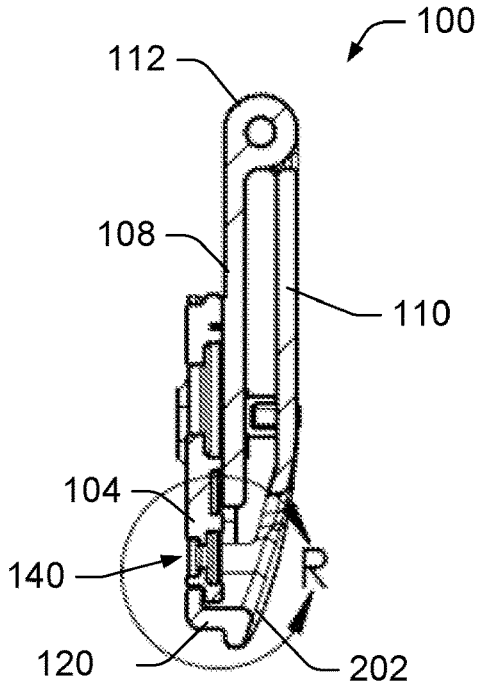
FIG. 4A shows a cross-section side view of an example locking belt slide assembly in a closed configuration, according to an implementation.
Figure 4B:
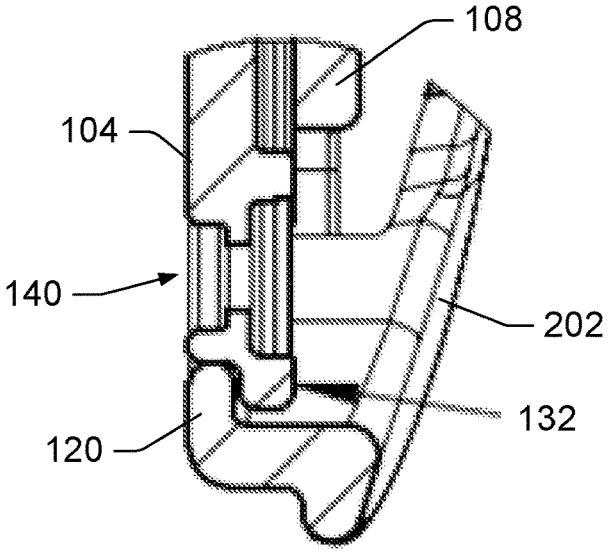
FIG. 4B shows a close detail cross-section side view of an example belt slide lock in a closed configuration, according to an implementation.

The location of the adapter 104 within the belt slide lock 120 also locks the belt slide 106 closed. For example, when the belt slide front 108 and back 110 are brought together in the closed configuration (by moving them at the hinge 112), the belt slide lock 120 matches up to the frame 116 of the receiver 102. One or more detents in the belt slide front 108 and back 110 (or similar) can hold the belt slide 106 in the closed configuration so that the adapter 104 can be moved into the pocket 114 of the receiver 102 and down into the belt slide lock 120. Once the rim 130, 132 of the adapter 104 is within the groove 122 of the belt slide lock 120, the adapter 104 holds the belt slide front 108 and back 110 together, not allowing them to separate until the adapter 104 is removed from the pocket 114 of the receiver 102. As shown at FIGS. 4A and 4B, the rim 132 of the adapter 104 is held against the inside groove 122 of the belt slide lock 120 when the adapter 104 is fully within the pocket 114 and the belt slide lock 120. This prevents the belt slide front 108 from moving away from the belt slide back 110, which locks the belt slide 106 closed.

Figure 5A:
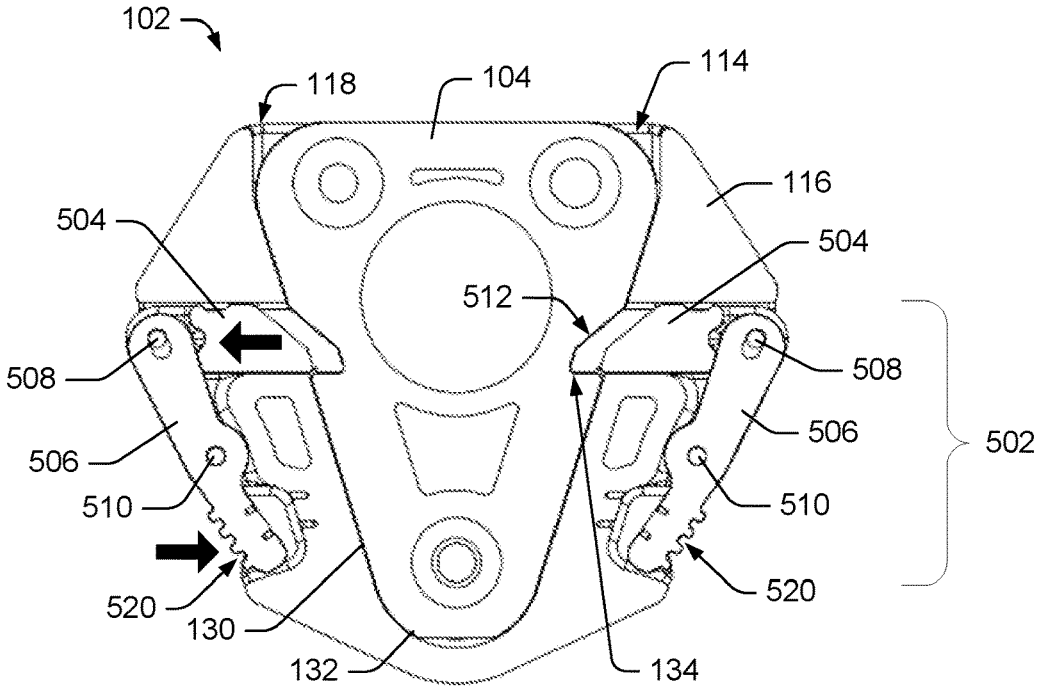
FIG. 5A shows a cross-section plan view of an example locking belt slide assembly in an unlocked configuration, according to an implementation.
Figure 5B:
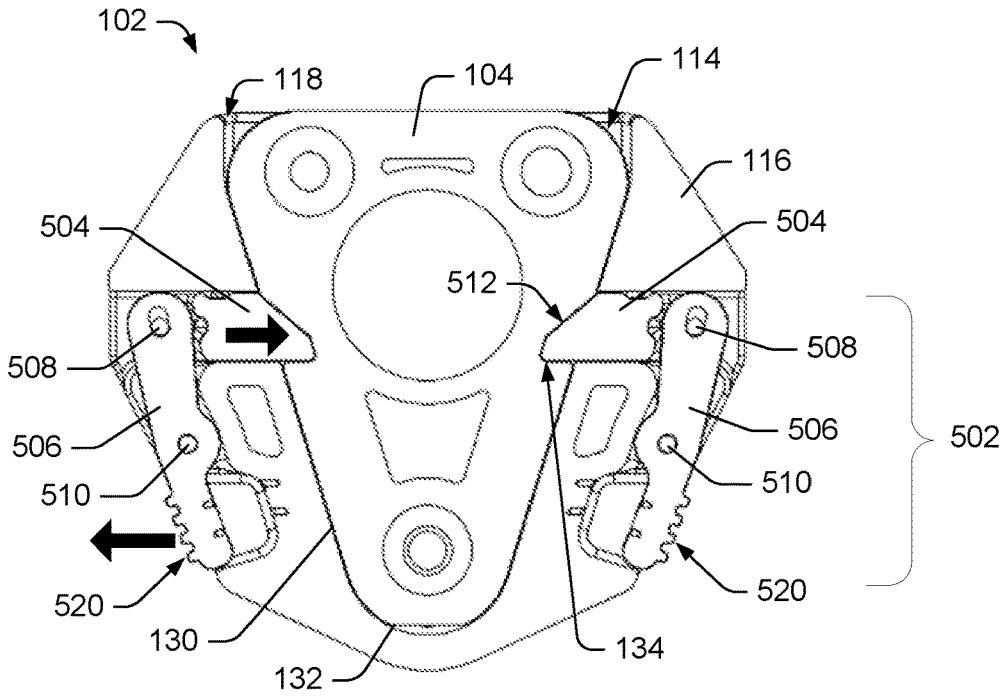
FIG. 5B shows a cross-section plan view of an example locking belt slide assembly in a locked configuration, according to an implementation.

FIGS. 5A and 5B show cutaway views of the adapter 104 within the receiver pocket 114. For example, the front layer of the receiver 102 is cut away to show the interior details. Referring to FIGS. 5A and 5B, as described in U.S. Pat. No. 11,047,644B2, which is incorporated by reference in its entirety, in various embodiments, the adapter 104 can be locked into the receiver pocket 114 using one or more locking components. In some embodiments, a spring loaded, sliding, or otherwise operated catch mechanism 502 that traps the adapter 104 in the receiver pocket 114 is used. The catch mechanism 502 ensures that the adapter 104 remains in the receiver pocket 114 until intentionally released by a user.

In one example, the catch mechanism 502 includes a post 504, which is arranged to engage a portion of the adapter 104 when extended, preventing the adapter 104 from exiting the receiver 102 until intentionally released by the user. In an embodiment, the post 504 extends through an opening or hole in the frame 116, and into the receiver pocket 114. The post 504 may engage a feature 134 (such as a notch, groove, tab, or the like) at a portion of the adapter 104, for instance at the rim 130 of the adapter 104. In various embodiments, the shape of the feature 134 may match or correspond to the shape of the end of the post 504, so that the post 504 engages the feature 134 in a secure manner.

Engaging the feature 134 at the portion of the adapter 104 blocks the adapter 104 from being removed from the receiver 102, trapping the adapter 104 in the receiver pocket 114. In some examples, the locking belt slide assembly 100 may include two or more catch mechanisms 502, engaging multiple features 134 of the adapter 104 to lock the adapter 104 into the receiver pocket 114.

The post 504 of the catch mechanism 502 may be operated using a user-operated actuator 506, for example. The actuator 506 can be a lever with one or more pivot points (e.g., 508 and 510). For instance, the post 504 may be pivotally coupled (at the upper pivot 508) to the actuator 506 near an end of the actuator 506. Also, the actuator 506 may be pivotally coupled (at the lower pivot 510) to the body of the receiver 102 near a mid-point (or other mechanically advantageous point) on the actuator 506, for instance.

As shown at FIG. 5A, moving the actuator 506 a first direction retracts the post 504 away from the adapter 104 (e.g., away from the notch 134 of the adapter 104), disengaging from the adapter 104 and clearing the adapter 104, allowing the adapter 104 to be removed from the receiver pocket 114. The adapter 104 may also be inserted into the receiver pocket 114 with the post 504 retracted (or extended). When the post 504 is retracted away from the adapter 104, it is the unlocked configuration of the catch mechanism 502, including the actuator 506 and the post 504.

In the example shown, moving the catch mechanism 502 into the unlocked configuration includes pressing on a lower portion 520 of the actuator 506 (which may include a textured surface at the lower portion 520 of the actuator 506 as an indication of an area to depress), which moves the lower portion of the actuator 506 toward the receiver 102 as the actuator 506 pivots on the lower pivot point 510. This rotation of the actuator 506 causes the upper portion of the actuator 506 to move away from the receiver 102, pulling the post 504 outward, at the upper pivot point 508. Consequently, the post 504 moves away (i.e., retracts) from the adapter 104, clearing the adapter 104.

As shown in FIG. 5B, moving the actuator 506 a second direction extends the post 504, engaging the adapter 104 (e.g., engaging the notch 134 of the adapter 104) with the post 504. The adapter 104 may not be removed from the receiver pocket 114 with the post 504 extended. This is the locked configuration of the catch mechanism 502, including the actuator 506 and the post 504.

In the example shown, moving the catch mechanism 502 into the locked configuration includes pivoting the actuator 506 on the lower pivot point 510 in an opposite direction and moving the lower portion of the actuator 506 away from the receiver 102. This rotation of the actuator 506 causes the upper portion of the actuator 506 to move toward the receiver 102 at the upper pivot point 508, and the post 504 moves toward the adapter 104 (i.e., extends), engaging the adapter 104.

In one example, the post 504 and/or the actuator 506 may be spring-loaded, biased, or the like, such that moving the actuator 506 in the first direction loads the spring, and the actuator 506 and post 504 moves in the second direction, into the locked configuration, when the spring tension is released (e.g., when the actuator lever 506 is released).

In an implementation, the post 504 may include a ramped portion 512, for instance, so that the adapter 104 can be inserted into the receiver 102 while in the locked configuration. For example, moving the adapter 104 against the ramped portion 512 (while the post 504 is extended) causes the post 504 to be moved out of the way of the adapter 104 (retracts the post 504), and puts the spring device (if present) of the post 504 into tension, until the adapter 104 is fully within the receiver pocket 114. The spring-action of the post 504 (or a manual action by the user on the actuator 506) can move the post 504 back into its extended position, engaging the feature 134 of the adapter 104 once the adapter 104 is fully in place in the pocket 114.

As an option in some implementations, the locking belt slide assembly 100 may also include one or more lock covers (not shown), configured to cover the actuator(s) 506 while in the locked position (with the post 504 extended), and to protect the actuators 506 from being accidentally or unintentionally moved to the unlocked position.

Figure 6:
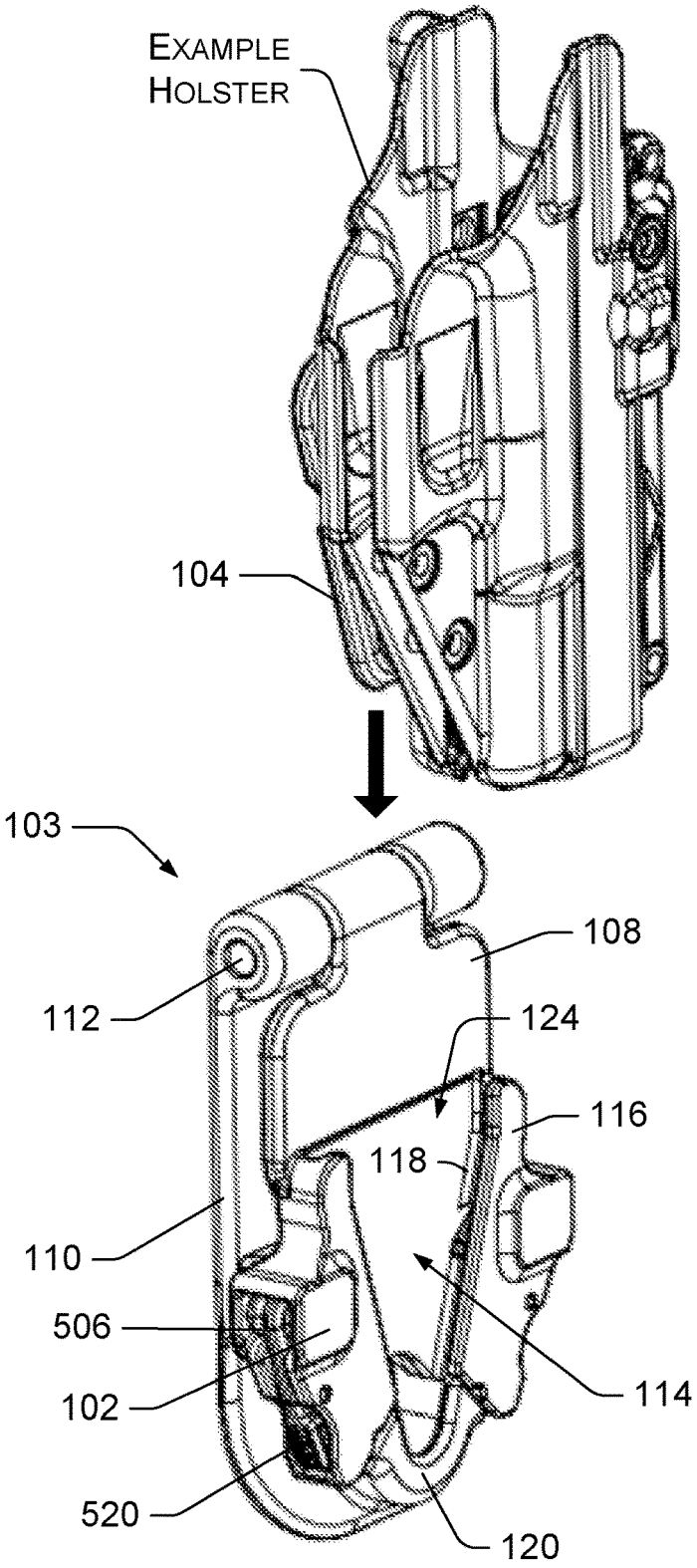
FIG. 6 shows a perspective view of an example locking belt slide assembly in a closed configuration, including an adapter attached to a holster, according to an implementation.

FIG. 6 is a perspective view showing an example of a holster (e.g., implement) mounted to a duty mount adapter 104. As shown in the illustration, the holster with the adapter 104 can be moved in to position relative to the receiver 102, inserting the adapter 104 into the receiver 102 to secure the holster to the belt slide 106. The adapter 104 may be engaged to the receiver 102 as described above, while in this configuration.

Figure 7A:
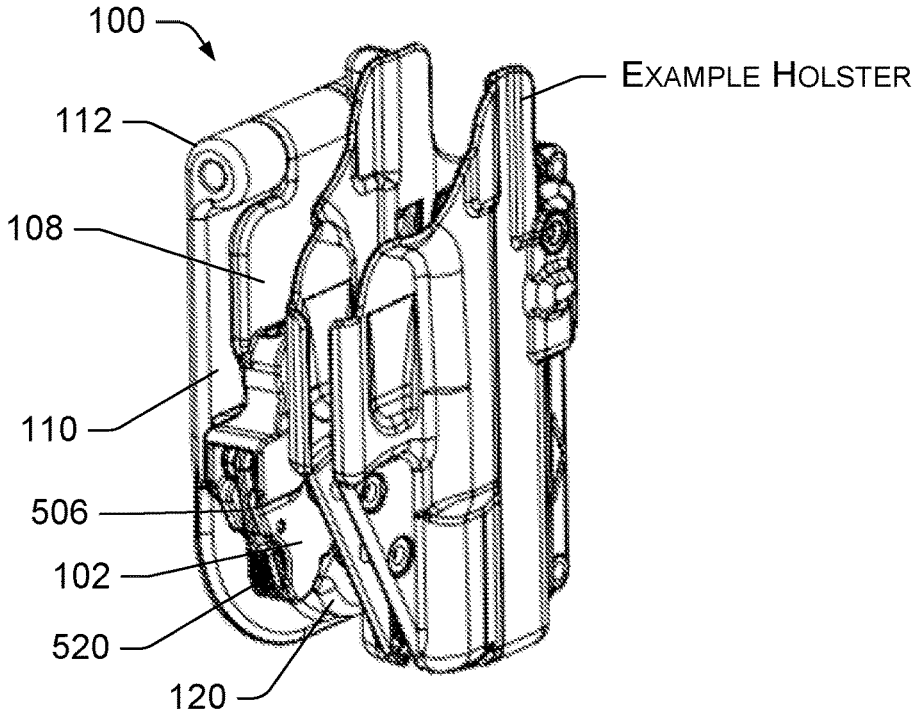
FIG. 7A shows a perspective view of an example locking belt slide assembly in a closed configuration, including an adapter attached to a holster coupled to the locking belt slide, according to an implementation.
Figure 7B:
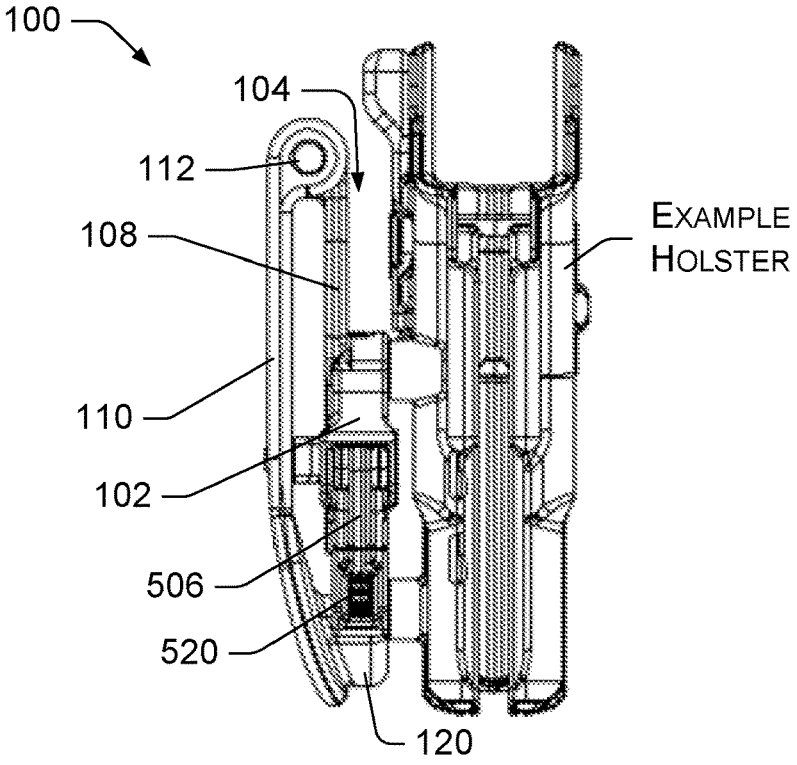
FIG. 7B shows a side view of an example locking belt slide assembly in a closed configuration, including an adapter attached to a holster coupled to the locking belt slide, according to an implementation.
Figure 8:
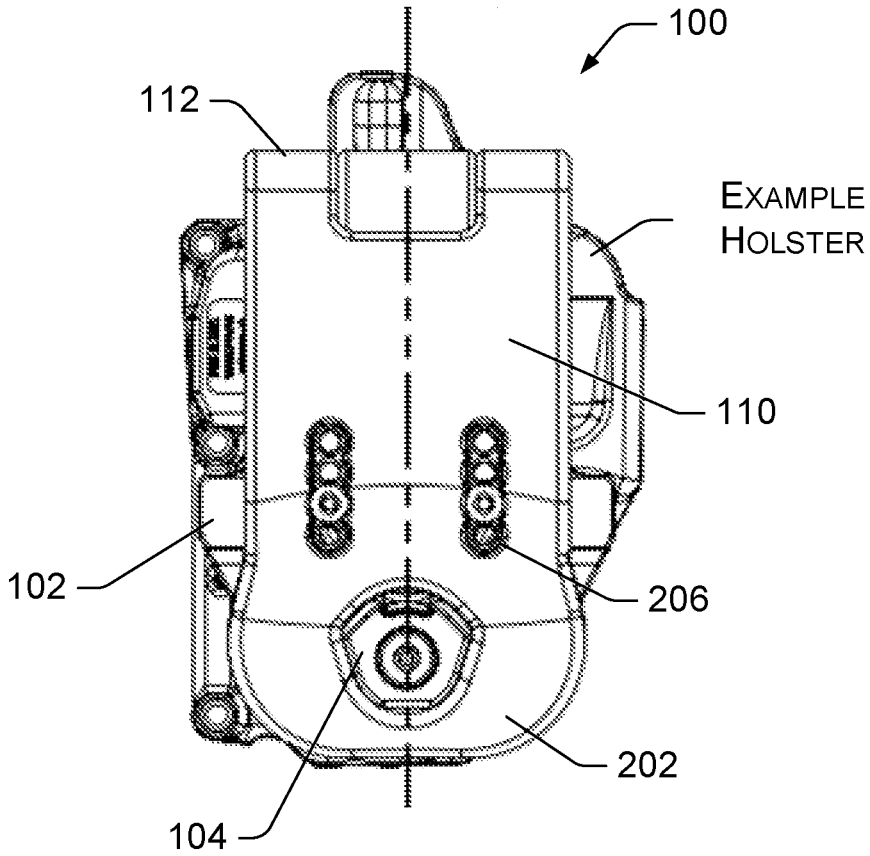
FIG. 8 shows a back view of an example locking belt slide assembly in a closed configuration, according to an implementation.

FIGS. 7A and 7B show views of the example holster mounted to the adapter 104, while the adapter 104 is locked into the receiver pocket 114. FIG. 8 shows a back view of the same. Note that the belt slide 106 is in the closed configuration in each of these views. The adapter 104 can be seen secured within the pocket 114 through an optional opening in the belt slide back 110.

The locking belt slide assembly 100 is discussed in terms of securing a holster, but the locking belt slide assembly 100 may be used to secure or mount any of various items, where secure mounting is desired. Although various implementations and examples are discussed herein, further implementations and examples may be possible by combining the features and elements of individual implementations and examples.

In various implementations, components of the locking belt slide assembly 100 are comprised of various plastics, composites, metals, combinations of the same, or the like. For example, the receiver 102 and/or the adapter 104 may be comprised of a polyamide, a composite, or similar material. For example, the locking belt slide assembly 100 components may be injection molded, stamped, formed, or the like. In various embodiments, the locking belt slide assembly 100 components have rigidity and stability properties based on a particular material selected for the locking belt slide assembly 100 components. For example, some materials that may be used include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, various metals and alloys, fiber composites, combinations of the same, and the like. Additionally, in some embodiments, the stability properties are also based on a thickness of the locking belt slide assembly 100 components.

In various implementations, the locking belt slide assembly 100 may include fewer, more, or alternate components, and remain within the scope of the disclosure. In various embodiments, the shape and configuration of the locking belt slide assembly 100 components may vary to accommodate different implements or applications. In an example, the receiver 102 and/or the adapter 104 may be formed to closely fit a particular implement. In other examples, the receiver 102 and/or the adapter 104 may be more generally formed to fit multiple implements.

The illustrations of FIGS. 1-8 are not intended to be limiting. In the various example embodiments illustrated in FIGS. 1-8, the location and position of the components, locking mechanisms, and the like are for example only. Other locations and positions are contemplated and are within the scope of this disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a locking belt slide assembly 100 may be implemented as a stand-alone device or as part of another system (e.g., integrated with other components, such as a duty belt).

As discussed above, the techniques, components, and devices described herein with respect to the implementations are not limited to the illustrations of FIGS. 1-8. In some cases, additional or alternative components, techniques, sequences, or processes may be used to implement the techniques described herein. Further, the components and/or techniques may be arranged and/or combined in various combinations, while resulting in similar or approximately identical results.

In the various example embodiments illustrated in FIGS. 1-8, the location and position of the components and features are for example. Other locations and positions are contemplated and are within the scope of this disclosure. In various implementations, the assembly 100 may include fewer, more, or alternate components, and remain within the scope of the disclosure.

Various implementations and examples are discussed herein, and further implementations and examples may be possible by combining the features and elements of individual implementations and examples.

CONCLUSION

While various discreet embodiments have been described throughout, the individual features of the various embodiments may be combined to form other embodiments not specifically described. The embodiments formed by combining the features of described embodiments are also within the scope of the disclosure.

What is claimed is:

1. A holster mounting assembly, comprising:

a belt slide front comprising a first substantially planar hard mount component;

a receiver integral to or coupled to the belt slide front, the receiver having a receiver pocket with a preselected perimeter shape, wherein the receiver pocket is defined by a frame disposed around at least a portion of a perimeter of the first substantially planar hard mount component, the frame including a groove at an interior edge of the frame;

a belt slide back comprising a second substantially planar hard mount component, a top of the second substantially planar hard mount component pivotally coupled to a top of the first substantially planar hard mount component via a hinge;

a belt slide lock integral to or coupled to a portion of the belt slide back, the belt slide lock comprising a curved ledge with a groove at an interior edge of the curved ledge, disposed at a lower portion of the second substantially planar hard mount component such that each end of the curved ledge aligns with a lower end of the frame when the first substantially planar hard mount component is disposed substantially parallel to the second substantially planar hard mount component; and an adapter arranged to be coupled to an implement or an implement holster, the adapter comprising a substantially planar component with a perimeter having at least a portion of the preselected perimeter shape of the receiver pocket, the adapter configured to be inserted into the receiver pocket and to securely fit within the receiver pocket when the belt slide lock is aligned with the frame of the receiver, wherein the adapter prevents the first substantially planar hard mount component from being pivoted away from the second substantially planar hard mount component while the adapter is within the receiver pocket.

2. The holster mounting assembly of claim 1, further comprising one or more lock mechanisms pivotally or slideably coupled to the receiver and configured to lock the adapter within the receiver pocket until intentionally released.

3. The holster mounting assembly of claim 1, wherein the frame comprises a raised portion that extends away from the first substantially planar hard mount component and wherein the belt slide lock comprises a raised portion that extends away from the second substantially planar hard mount component.

4. The holster mounting assembly of claim 1, wherein the perimeter edge of the adapter has a thickness that is less than a thickness of an interior portion of the adapter, and wherein the thickness of the perimeter edge matches a thickness of the groove of the frame and the groove of the curved ledge.

5. The holster mounting assembly of claim 1, wherein a perimeter edge of the adapter is disposed within the groove of the frame and within the groove of the curved ledge when the adapter is within the receiver pocket.

6. The holster mounting assembly of claim 1, wherein the implement comprises a firearm and the implement holster comprises a holster for a firearm.

7. A mount assembly, comprising:

a first substantially planar hard mount component;

a receiver integral to or coupled to the first substantially planar hard mount component, the receiver having a receiver pocket with a preselected perimeter shape;

a second substantially planar hard mount component pivotally coupled at a first end of the second substantially planar hard mount component to a first end of the first substantially planar hard mount component;

a locking ledge comprising a curved raised portion that extends away from the second substantially planar hard mount component such that the locking ledge aligns with an end of the receiver when the first substantially planar hard mount component is substantially parallel to the second substantially planar hard mount component; and an adapter, comprising a substantially planar component with a perimeter having the preselected perimeter shape, the adapter configured to be inserted into the receiver pocket and to securely fit within the receiver pocket when the locking ledge is aligned with the end of the receiver, wherein the adapter prevents the first substantially planar hard mount component from being pivoted away from the second substantially planar hard mount component while the adapter is within the receiver pocket.

8. The mount assembly of claim 7, wherein the second substantially planar hard mount component is pivotally coupled to the first substantially planar hard mount component via a hinge.

9. The mount assembly of claim 7, wherein the second substantially planar hard mount component is pivotally coupled behind the first substantially planar hard mount component.

10. The mount assembly of claim 7, wherein the receiver pocket is defined by a frame disposed around at least a portion of a perimeter of the receiver, the frame including a groove at an interior edge of the frame.

11. The mount assembly of claim 10, wherein the frame comprises a raised portion that extends away from the first substantially planar hard mount component.

12. The mount assembly of claim 10, wherein each end of the locking ledge meets up with a lower end of the frame when the first substantially planar hard mount component is substantially parallel to the second substantially planar hard mount component.

13. The mount assembly of claim 7, wherein the locking ledge forms a portion of the receiver pocket when the first substantially planar hard mount component is substantially parallel to the second substantially planar hard mount component.

14. The mount assembly of claim 7, wherein the locking ledge includes a groove at an interior edge of the locking ledge.

15. The mount assembly of claim 14, wherein a groove of the frame is aligned with the groove of the locking ledge when the first substantially planar hard mount component is substantially parallel to the second substantially planar hard mount component.

16. The mount assembly of claim 7, wherein a perimeter edge of the adapter is disposed within the groove of the frame and the groove of the ledge when the adapter is within the receiver pocket.

17. A mount assembly, comprising:

a belt slide, comprising;

a first substantially planar component having an integral receiver, the receiver having a receiver pocket with a preselected receiver pocket perimeter shape;

a second substantially planar component pivotally coupled behind the first substantially planar component via a hinge; and a locking ledge comprising a curved raised portion that extends away from the second substantially planar component such that the locking ledge aligns with the receiver pocket when the first substantially planar component is substantially parallel to the second substantially planar component; and an adapter, comprising a substantially planar component with a perimeter having the preselected receiver pocket perimeter shape, the adapter configured to be inserted into the receiver pocket and to securely fit within the receiver pocket when the locking ledge is aligned with the end of the receiver pocket, wherein the adapter prevents the first substantially planar component from being pivoted away from the second substantially planar component while the adapter is within the receiver pocket.

18. The mount assembly of claim 17, further comprising one or more lock mechanisms pivotally or slideably coupled to the receiver and configured to lock the adapter within the receiver pocket until intentionally released.

* * * * *